United States Patent [19]

Schrewelius, deceased

[11] 4,429,019

[45] Jan. 31, 1984

[54] HEAT-RESISTANT MACHINE COMPONENT

[75] Inventor: Nils G. Schrewelius, deceased, late of Hallstahammar, Sweden, by Maud Schrewelius, legal representative

[73] Assignee: Bulten-Kanthal AB, Hallstahammar, Sweden

[21] Appl. No.: 226,992

[22] Filed: Jan. 21, 1981

[30] Foreign Application Priority Data

Jan. 3, 1980 [SE] Sweden ..... 8000750

[51] Int. Cl.[3] ..... B32B 15/02

[52] U.S. Cl. ..... 428/550; 428/611; 428/613; 428/629; 428/653; 428/656; 428/676; 428/680; 428/926; 428/937; 416/241 R; 416/241 B

[58] Field of Search ..... 428/611, 612, 613, 607, 428/629, 632, 633, 656, 639, 653, 678–685, 937, 676, 926, 550, 552; 416/241 R, 241 B

[56] References Cited

U.S. PATENT DOCUMENTS

| | | | |
|---|---|---|---|
| 3,729,295 | 4/1973 | Weinstein et al. | 428/682 |
| 3,961,098 | 6/1976 | Bessen | 428/678 |
| 3,990,862 | 11/1976 | Dahl et al. | 428/613 |
| 4,141,802 | 2/1979 | Duparque et al. | 428/614 |
| 4,145,481 | 3/1979 | Gupta et al. | 428/678 |
| 4,313,760 | 2/1982 | Dardi et al. | 428/633 |

OTHER PUBLICATIONS

Sims, C. T., et al., *The Super Alloys,* J. Wiley & Sons, pp. 602, 603, (1972).

*Metal Selector,* Penton Publishing, Cleveland, Ohio, pp. 5–12, (1963).

*Primary Examiner*—Michael L. Lewis

*Attorney, Agent, or Firm*—Pollock, Vande Sande & Priddy

[57] ABSTRACT

A heat resistant machine component, e.g. a gas turbine blade, a vane or the like, for use in a hot-gas atmosphere, especially under dynamic mechanical strain. The engine component comprises a core body consisting of a heat resistant material and a surface layer sprayed thereon and constituted by a composite material. The composite material consists on the one hand of an alloy component containing 1 to 12% Al, namely preferably 3 to 8% Al, 10 to 30% Cr, small quantities of one or more elements in the group Si, Mn, Co, Y and Hf, and the balance Fe, and on the other hand a small quantity of an oxide component containing $Al_2O_3$ and possibly one or more oxides of the remaining metals of the alloy component, wherein the pores and the oxide component form elongated, narrow regions, which partly surround or cover the alloy component. The surface layer is applied by flame or arc spraying under a controlled minor oxidation.

12 Claims, 1 Drawing Figure

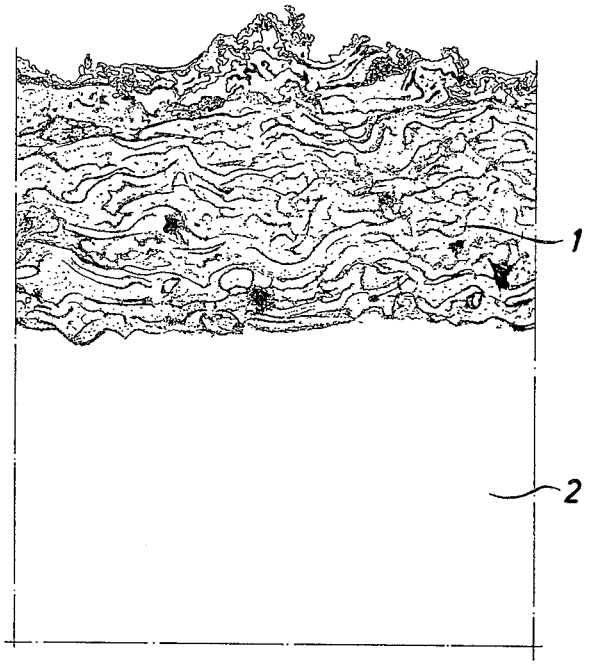
1
2

HEAT-RESISTANT MACHINE COMPONENT

The invention relates to a heat-resistant machine component and a method to manufacture the same, e.g. a gas turbine blade, a vane or the like for use in a hot-gas atmosphere, especially under dynamic mechanical strain.

Gas turbine components, under operation, are exposed to extremely high strain by the combination of, on the one hand, mechanical forces caused by high gas pressures and rotational speeds and, on the other hand, elevated and quickly varying temperatures. The desire to achieve higher and higher efficiency makes it necessary for the materials involved to stand such strain and thus to be resistant to high temperatures, corrosion and erosion.

The high temperature strength of the classical materials based on steel, nickel, cobalt is drastically reduced at 850°-900° C. Basically, these materials cannot be used at higher temperatures and cannot be improved essentially either.

Therefore, other ways have been pursued in order to obtain a material for use at higher temperatures. As an example of such materials the s.c. cermets can be mentioned, i.e. highly refractory metal-ceramic materials, the ceramic phase of which consists essentially of refractory carbides or oxides. Also, certain molybdenum alloys have a high temperature strength up to 1200° C. Cermets are, however, brittle by nature, and molybdenum alloys are not sufficiently oxidation-resistant and cannot be improved by alloying techniques.

The problem of obtaining a material with the desired properties has now resulted in the method of applying a protecting layer on the surface, and such layers can be accomplished in many different ways, e.g. by mechanical plating, diffusion, chemical plating, electrolytic plating, dipping, spraying and enamelling.

To protect gas turbines at high temperatures, one has proposed to form different high-temperature coatings by spraying, e.g. zirconium oxide. According to an article "$ZrO_2$ coatings on NIMONIC alloys", J. M. Nijpjes, in High Temperature Materials, 6 Plansee Seminar, 1968, p. 481, the object was to increase the operational temperature of an industrial gas turbine from approx. 1200° to approx. 1400° C. The purpose in this case was to increase the power of the gas turbine. The basic material used was NIMONIC 115 (a trademark for an alloy containing 18% Cr, 5.2% Mo, 2.3% Ti, 0.8% Al, 38% Ni, and the balance Fe), which is one of the strongest nickel-based materials to be found. The maximum temperature for this alloy is 1000° C., and therefore it has to be protected, should the temperature be raised even more.

Thus, a layer (about 1 mm thick) of zirconium oxide was applied by spraying, firstly by plasma spraying and secondly by flame spraying. In this case, the porosity of the flame-sprayed layer turned out to be clearly higher than the one of the plasma-sprayed layer. The author points out that the zirconium coating of 1 mm thickness enables the design of gas turbines for an inlet temperature of between 1200° and 1400° C., but one must consider problems due to the rough surface and the porosity of the oxide layer.

In the same reference, p. 803, "Corrosion resistant coating for refractory metals and super-alloys", J. D. Gadd informs i.a. of vacuum pack diffusion of aluminide in nickel-based alloys. During this process beta-phase of NiAl is primarily formed.

A further method of coating a turbine blade is vacuum coating, which method is likewise described in the above-mentioned reference, namely on p. 854, by A. M. Shroff "Vapor deposition of refractory metals". The layers applied by this method are very thin but, on the other hand, exhibit a high density, namely 98,5 to 99% of the theoretical one, and can be made gas tight.

The vacuum coating of thin surface layers is also described in the Swedish Laid-Open Print 345 146 (published 1972-05-15). The surface layer consists in this case of 20 to 50% Cr, 10 to 20% Al, 0,03 to 2% Y (or one or more of the rare earth metals), and the balance Fe. The thickness of the layer is very small (approx. 0.07 mm) and, consequently, the surface layer cannot always secure sufficient heat shock resistance of the coated machine component. Moreover, the aluminum in the surface layer has the tendency to diffuse into the base material, so that a protective oxide coating can no longer be maintained. For an acceptable life, the Al percentage must therefore be at least 10 percent by weight and preferably higher, such as 12 to 14%.

In contrast thereto, the present invention relates to the application of a protective layer by s.c. thermal spraying. It has previously been proposed to spray a layer of the composition Ni-Cr-B, Ni-Si-B or Al-Si-Cr. Such protective layers are of course ductile and mechanically shock resistant but have low heat-cycling resistance. The layers also have low erosion resistance but can be oxidation resistant up to at least 1000°-1100° C.

In the German published patent application No. 2 842 848, published Apr. 19, 1979, it is further suggested, for the purpose of increasing the oxidation resistance of superalloys, to spray a coating with the composition M-Cr-Al-Y, where M is an element chosen from the group Ni, Co and Fe, and preferably containing 10 to 40% Cr, 8 to 30% Al, 0,01 to 5% Y and wherein 5 to 85% chrome carbide particles were dispersed. A coating applied by plasma spraying resisted 500 hours at 927° C. without forming any cracks. The U.S. Pat. No. 4,145,481, published Mar. 20, 1979, describes a coating accomplished by hot-isostatic pressing for e.g. gas turbines. Even here, a layer of the composition Co-Cr-Al-Y is applied by plasma spraying.

The object of the present invention is to achieve a surface layer suitable for machine components and a method of manufacturing such components so as to secure good resistance to high temperatures, even in case of great temperature variations, good resistance to oxidation and erosion, even in the presence of strongly corrosive gases, and excellent strength when loaded statically as well as dynamically, particularly at heavy vibration.

According to the invention, this object is achieved for a machine component comprising a core body consisting of a heat resistant material and a surface layer sprayed thereon, essentially consisting of a Fe-Cr-Al-alloy, the characteristic feature of the invention being that the surface layer is formed by a composite material. The composite material has a porosity of up to 8% by volume and comprises a Fe-Cr-Al alloy component and a minor quantity of an oxide component containing $Al_2O_3$. The pores and oxide component of the surface layer form elongated, narrow regions which partly surround or cover the alloy component.

Furthermore, the inventive machine component is preferably produced by flame or arc spraying of an alloy of the particular composition, preferably in the form of a thread. By subsequent mechanical treatment of the surface layer, e.g. by grinding or polishing, the corrosion resistance may increase even more.

The composite material forming the surface layer comprises an alloy component as well as a minor quantity of an oxide component. The alloy component contains (by weight) 1 to 12% Al, namely preferably 3 to 8% Al, 10 to 30% Cr, small quantities of one or more elements in the group Si, Mn, Co, Y and Hf, and the balance Fe, whereas the oxide component contains $Al_2O_3$ and possibly also one or more oxides of the remaining metals of the alloy component.

The oxide content in the surface layer should not exceed approx. 5% (by volume), and the porosity of the surface layer should not exceed 8%, preferably 1 to 4%.

The structure of the surface layer appears from the appended figure, which illustrates a microscope picture of a composite layer 1, sprayed onto a core body 2 consisting of a Fe-Cr-Ni-alloy (magnification approx. 120 times). The pores and oxide component in the surface layer form elongated, wave-like, narrow regions(-corresponding to the blackened lines of the picture), extending essentially in parallel to the interface (or the surface of the layer), so as to partly surround or cover the alloy component. The thickness of the regions amounts to max. 2 μm, normally approx. 0.1 to 0.5 μm.

Hitherto, one has aimed at attaining very thin surface layers when coating gas turbine blades with Fe-Cr-Al-alloys, e.g. by vacuum coating. However, according to the present invention it is suggested that the protective surface layer is sprayed on with a relatively great thickness, namely at least 0.15 mm, in particular 0.3 to 3.0 mm (the residual thickness after a possible mechanical treatment). This results in a heat barrier, because the surface layer has a lower heat conductivity than the heat resistant alloy, which would normally constitute the core body, e.g. chrome steel (13% Cr), nickel-chrome steel (18% Cr, 8% Ni), the alloys known under the following trademarks NIMONIC 75, HASTELLOY X, INCONEL 600, INCOLOY 800 and similar materials. The heat barrier protects the core body material against excessive temperatures and, most importantly, against heat shocks. Thus, the heat barrier dampens sudden temperature variations, whereby cracking caused by thermal shocks can be avoided to a higher extent than before. The heat barrier is especially effective because the thermal conductivity of the surface layer is lower transversally to the surface than in parallel to the same, which is due to the wave-like construction of the composite surface layer, giving the surface layer an anisotropic structure (compare the microscope picture).

A rather thick surface layer according to the invention has also a good ability to absorb vibrations, and therefore the dynamic strength is improved still more. The sound damping effect is likewise very good.

The spraying operation is performed in a method known per se by means of a flame sprayer or an arc sprayer, as previously described in the Swedish patent specification 7807523-1.

According to the present invention, a thread of the abovementioned composition (for the alloy component) is preferably used. The spraying operation is performed under controlled minor oxidation while using e.g. argon as an atomizing gas. The composite material and the above-mentioned regions, which partly surround the alloy grains, are formed spontaneously. The thread diameter is 1.5 to 5 mm, preferably 2.0 to 2.5 mm, and the particular value is chosen in view of the desired layer thickness.

If the machine component is to be exposed to very high temperatures, the sprayed surface layer should be treated mechanically so as to obtain a surface as smooth as possible. Such treatment can be performed by grinding or polishing, and the removal normally amounts to approx. 0.2 to 0.3 mm. As mentioned above, the remaining thickness of the layer should be at least 0.15 mm. Owing to the improved surface smoothness, namely max. RA5, a very good resistance to corrosion and erosion is obtained. The hardness of the layer is approx. 230 HB.

In order to obtain a sufficient adherence between the core body and the surface layer, it is in certain cases necessary to first spray onto the core body a very thin bond layer, e.g. of nickel-aluminum or copper, and only thereafter, the composite surface layer. This kind of bond or intermediate layer also serves to counteract the diffusion of e.g. nitrogen and aluminum between the surface layer and the core body. In case the difference in thermal expansion coefficient between the core body and the composite surface layer is relatively large, it could likewise be suitable to achieve a successive transition between the underlying and the coated materials by applying at least one intermediate layer. In the illustrated example, the thermal expansion coefficients of the core body and the surface layer are approximately of the same magnitude, namely $19\times10^{-6}$ °C. and $14\times10^{-8}$ °C., respectively, and for this reason an intermediate layer is not needed.

It has turned out that coated bodies according to the invention are resistant to corrosion in an oxidizing atmosphere at temperatures up to approx. 1350° C. Except for gas turbine blades, the coating can be used in several applications. Practical tests have been successfully performed with coatings in combustion chambers in internal combustion engines, protective layers on electrodes of molybdenum, and as corrosion protection on fan blades in furnaces. The material has also been tested in the boiler of a steam power plant while exposing the surface layer to appr. 800° to 900° C. during 7000 hours in an atmosphere containing 1000 ppm $SO_2$. The corrosion depth in the surface was only 50 μm.

As substrate for the surface layer a plurality of metallic materials can be used, e.g. mild steel, molybdenum, chrome-steel, chrome-nickel-steel as well as the materials marketed under the following trademarks: KANTHAL, NIKROTHAL, KANTHAL SUPER, INCOLOY, HASTELLOY, INVAR, NIMONIC, INCONEL, etc.

I claim:

1. A heat resistant machine component for use in a hot-gas atmosphere under dynamic mechanical strain which comprises a core body of heat resistant material and a composite surface layer sprayed thereon wherein said surface layer has a porosity of up to 8% by volume and comprises a Fe-Cr-Al alloy component consisting essentially of 1-12% Al, 10-30% Cr, small quantities of at least one element selected from the group of Si, Mn, Co, Y, Hf, or mixtures thereof, and the balance being substantially Fe; and a minor quantity of an oxide component containing $Al_2O_3$; wherein the pores and the oxide component form elongated, narrow regions which partly surround or cover said alloy component and wherein the narrow regions are wave-like and extend in a main direction substantially parallel to the surface of the surface layer and wherein the thickness of said narrow regions is up to 2 μm.

2. A machine component as set forth in claim 1, characterized in that the oxide content in the surface layer is up to 5% by volume.

3. A machine component as set forth in claim 1, characterized in that the porosity of the surface layer is 1 to 4% by volume.

4. A machine component as set forth in claim 1, characterized in that the thickness of the surface layer is at least 0.15 mm.

5. A machine component as set forth in claim 4, characterized in that the thickness is 0.3 to 3.0 mm.

6. The machine component of claim 1 wherein said alloy component contains 3–8% Al.

7. The machine component of claim 1 wherein said machine component is a gas turbine blade.

8. The machine component of claim 1 wherein said machine component is a gas turbine vane.

9. The machine component of claim 1 which contains a thin bonding layer between the core body and surface layer.

10. The machine component of claim 9 wherein said bonding layer is of nickel-aluminum or of copper.

11. The machine component of claim 1 which is free of a bonding layer between the core body and surface layer.

12. The machine component of claim 1 wherein the thickness of said narrow regions is about 0.1 to 0.5 μm.

* * * * *

UNITED STATES PATENT AND TRADEMARK OFFICE

CERTIFICATE OF CORRECTION

PATENT NO. : 4,429,019

DATED : January 31, 1984

INVENTOR(S) : Schrewelius (Deceased)

It is certified that error appears in the above-identified patent and that said Letters Patent is hereby corrected as shown below:

On the title page, Item /30/, "Jan. 3, 1980" should read -- Jan. 30, 1980 --.

Signed and Sealed this

*Twenty-fourth* Day of *July 1984*

[SEAL]

*Attest:*

GERALD J. MOSSINGHOFF

*Attesting Officer*

*Commissioner of Patents and Trademarks*